US010167540B2

(12) United States Patent
Tuncer et al.

(10) Patent No.: US 10,167,540 B2
(45) Date of Patent: Jan. 1, 2019

(54) CONTINUOUS OLIGOCRYSTALLINE SHAPE MEMORY ALLOY WIRE PRODUCED BY MELT SPINNING

(71) Applicant: Massachusetts Institute of Technology, Cambridge, MA (US)

(72) Inventors: Nihan Tuncer, Somerville, MA (US); Christopher A. Schuh, Wayland, MA (US)

(73) Assignee: Massachusetts Institute of Technology, Cambridge, MA (US)

( * ) Notice: Subject to any disclaimer, the term of this patent is extended or adjusted under 35 U.S.C. 154(b) by 195 days.

(21) Appl. No.: 14/705,247

(22) Filed: May 6, 2015

(65) Prior Publication Data

US 2015/0354046 A1 Dec. 10, 2015

Related U.S. Application Data

(60) Provisional application No. 61/988,945, filed on May 6, 2014.

(51) Int. Cl.

| | |
|---|---|
| ***C22C 9/01*** | (2006.01) |
| ***C22F 1/08*** | (2006.01) |
| ***B21C 37/04*** | (2006.01) |
| ***B22D 11/00*** | (2006.01) |

(52) U.S. Cl.

CPC ..... *C22F 1/08* (2013.01); *B21C 37/045* (2013.01); *B22D 11/005* (2013.01); *C22C 9/01* (2013.01); *Y10T 428/12* (2015.01)

(58) Field of Classification Search

None

See application file for complete search history.

(56) References Cited

U.S. PATENT DOCUMENTS

| | | | | |
|---|---|---|---|---|
| 5,611,874 | A * | 3/1997 | Zadno-Azizi | B21C 37/042 148/402 |
| 8,282,746 | B2 | 10/2012 | Schuh et al. | |
| 9,018,117 | B2 | 4/2015 | Schuh et al. | |
| 9,091,314 | B2 | 7/2015 | Schuh et al. | |
| 9,512,039 | B2 | 12/2016 | Schuh et al. | |
| 2007/0202296 | A1 * | 8/2007 | Chandrasekaran | B29C 70/22 428/124 |
| 2011/0226379 | A2 * | 9/2011 | Johnson | C22C 9/01 140/71 R |

(Continued)

OTHER PUBLICATIONS

Ueland, S.M. et al., "Oligocrystalline Shape Memory Alloys", Advanced Functional Materials, vol. 22, pp. 2094-2099, published online Mar. 1, 2012.*

(Continued)

*Primary Examiner* — George Wyszomierski
(74) *Attorney, Agent, or Firm* — Theresa A. Lober

(57) ABSTRACT

There is provided herein a shape memory alloy wire that includes an alloy composition of CuAlMnNi and excluding grain refiner elements. The alloy composition includes 20 at %-28 at % Al, 2 at %-4 at % Ni, 3 at %-5 at % Mn with Cu as a remaining balance of the alloy composition. The alloy composition is disposed as an elongated wire of at least about 1 meter in length, having a wire diameter of less than about 150 microns. At least about 50 vol % of said alloy composition along said wire length has an oligocrystalline microstructure as-disposed in the wire and without thermal treatment of the wire.

14 Claims, 10 Drawing Sheets

(56) References Cited

U.S. PATENT DOCUMENTS

| | | | |
|---|---|---|---|
| 2014/0255693 | A1 | 9/2014 | Schuh et al. |
| 2015/0337420 | A1 | 11/2015 | Schuh et al. |
| 2016/0265089 | A1 | 9/2016 | Schuh et al. |

OTHER PUBLICATIONS

Gager, M., thesis entitled "Cu-based Shape Memory Microwires: Towards Complex Structures", Department of Materials Science and Engineering, Massachusetts Institute of Technology, Jun. 4, 2014.*

PCT/US2015/029405 International Search Report, Form PCT/ISA/210 first sheet, second sheet, and continuation of second sheet, dated Jan. 2016.

PCT/US2015/029405, PCT Written Opinion of the International Searching Authority, Form PCT/ISA/237 Cover Sheet, Box No. 1 sheet, Box No. V sheet, and Separate sheets 1-5, dated Jan. 2016.

EP Application No. 15784503.3-1362, EPO Communication Pursuant to Art. 94(3) EPC, EPO Form 2001 Letter pp. 1-2, Examination sheets 1-6, dated Oct. 2017.

EP Application No. 15784503.3-1362, Response to EPO Communication of Oct. 2017, Letter pp. 1-6, claim listing pp. 1-3, dated Apr. 2018.

EP Application No. 15784503.3-1362, EPO Communication Pursuant to Art. 94(3) EPC, EPO Form 2001 Letter pp. 1-2, Examination sheet 1, Form 2036 sheet 1, dated Jul. 2018.

EP Application No. 15784503.3-1362, Response to EPO Communication dated Jul. 2018, Letter p. 1, claim listing pp. 1-3, Jul. 2018.

JP Application No. 2016-566903, JP Examiner Notice English translation, pp. 1-2, Mar. 2018.

JP Application No. 2016-566903, Response to JP Examiner Notice of Mar. 2018, Letter pp. 1-4, claim listing pp. 1-4, Apr. 2018.

Chen et al., "Shape memory and superelasticity in polycrystalline Cu—Al—Ni microwires," Applied Physics Letters, V. 95, pp. 171906-1-17906-3, Oct. 2009.

Goryczka, "Effect of wheel velocity on texture formation and shape memory in Cu—Al—Ni based melt-spun ribbons," Archives of Metallurgy and Materials, vol. 54, No. 3, pp. 755-763, Dec. 2009.

Segui et al, "Characterization of cu—al—ni based melt spun shape memory ribbons," Proceedings of the International Conference on Solid-Solid Phase Transformations, (JIMIC-3) pp. 1072-1075, Japan, Dec. 1999.

Chen et al., "Determination of the parent grain orientation and habit plane normals for the b'1 martensite in a Cu—Al—Ni—Mn shape memory alloy," Journal of Materials Science, vol. 32, pp. 3769-3773, Jul. 1997.

Morris et al., "Microstructural influence on ductility and shape memory effect of some modified Cu—Ni—Al alloys," Scripta Metallurgica et Materialia, vol. 25, No. 6, pp. 1409-1414, Jun. 1991.

* cited by examiner

CONTINUOUS OLIGOCRYSTALLINE SHAPE MEMORY ALLOY WIRE PRODUCED BY MELT SPINNING

CROSS-REFERENCE TO RELATED APPLICATIONS

This application claims the benefit of U.S. Provisional Application No. 61/988,945, filed May 6, 2014, the entirety of which is hereby incorporated by reference.

STATEMENT REGARDING FEDERALLY SPONSORED RESEARCH

This invention was made with Government support under Contract No. W911NF-13-D-001, awarded by the U.S. Army Research Office. The Government has certain rights in this invention.

BACKGROUND

This invention relates generally to shape memory materials, and more particularly relates to shape memory alloy wire composition and production.

Shape memory materials are solid state materials that can undergo a reversible transformation between two distinct morphological phases, namely, a martensitic phase and an austenitic phase. Such phase transformation can in general be induced by exposure to an external stimulus such as, e.g., a change in temperature or an applied mechanical stress, thereby displaying a shape memory capability and a superelasticity capability, respectively. The most widely employed shape memory materials are metals, and in particular metal alloys. Shape memory alloys (SMAs) are well-known for their ability to transform between martensitic and austenitic phases with superior shape memory and superelastic behavior. This phase change behavior enables a very wide range of electromechanical actuation configurations as well as energy dissipation and mechanical damping. As a result, SMA materials are important for many advanced engineering applications.

Many advanced applications for SMA materials require microscale mechanical configurations of the SMA into a selected geometry. But the microscale counterpart to macroscale SMA structures such as ribbons, plates, and wires are technically very challenging to achieve. Specifically, the production of micro-scale structures of shape memory alloys remains a nontrivial materials processing challenge. Because shape memory alloys tend to undergo a stress-induced martensitic transformation, deformation processing of shape memory alloy materials in the formation of a microstructure can be problematic; the materials retain a memory of the unprocessed, undeformed shape. Further, conventional SMA materials such as Cu—Al—Ni and Cu—Zn—Al exhibit poor cold-workability due to their high-degree order in the parent phase with B2, $D0_3$, or $L2_1$ structure as well as an extremely high elastic anisotropy ratio in the β phase.

For example, there has been shown the production of shape memory alloy wire, and in particular copper-based SMA wire, by a process including hot rolling followed by cold rolling. But this dual-rolling production technique is limited to formation of relatively large wire diameter, e.g., greater than 500 μm, due to the limited workability of the SMA material. To overcome this limitation, it has been shown to codraw a SMA composition in the liquid phase within an outer glass capillary. This drawing technique overcomes the limitations of the mechanical rolling process, but requires a post-production step of glass layer removal to uncover the drawn wire and cannot continuously produce long lengths of wire.

Indeed, it is found that microscale production of SMA material structures remains difficult, and for many applications, cost-prohibitive, inflexible, and unable to be adapted for continuous processing. As a result, advanced technical applications requiring SMA microscale structures such as SMA fibers cannot be optimally addressed.

SUMMARY

There is provided herein a shape memory alloy wire that includes an alloy composition of CuAlMnNi and excluding grain refiner elements. The alloy composition includes 20 at %-28 at % Al, 2 at %-4 at % Ni, 3 at %-5 at % Mn with Cu as a remaining balance of the alloy composition. The alloy composition is disposed as an elongated wire of at least about 1 meter in length, having a wire diameter of less than about 150 microns. At least about 50 vol % of said alloy composition along said wire length has an oligocrystalline microstructure as-disposed in the wire and without thermal treatment of the wire.

The shape memory alloy wire can be provided with an alloy composition that includes CuAlMnNi and excluding grain refiner elements, with the alloy composition having 20 at %-28 at % Al, 2 at %-4 at % Ni, 3 at %-5 at % Mn with Cu as a remaining balance of the alloy composition. Here the alloy composition is disposed as an elongated wire of at least about 1 meter in length, having a wire diameter of at least about 150 microns. At least about 50 vol % of the alloy composition along the wire length has an oligocrystalline microstructure.

These wires can be formed in a process provided herein in which the alloy composition is heated until the alloy composition is a melted alloy material that is at temperature of between about 1100° C.-1400° C. The melted alloy material is ejected, at an ejection pressure of between about 3 bar-5 bar, through a nozzle having a diameter of between about 200 microns-280 microns onto a melt spinning wheel having a wheel speed of between about 9 m/s and about 13 m/s, forming a wire having a length of at least about 1 meter and a diameter of less than about 150 microns.

The SMA wire provided herein achieves SMA performance that far surpasses that of conventional melt-spun wire and that is comparable to that of single crystalline wire. The Cu-based wire structures provided herein achieve such superior SMA and superelastic properties that many technical applications now addressed predominantly only by TiNi alloys can be successfully implemented with lower-cost Cu-based alloys. Electrical connectors used in electronic sockets, e.g., for fast data transfer, surgical and medical guide wires, dental braces, intelligent fabrics, like smart curtains that coil up when warmed by sun light, are among the many applications of these low-cost SMA wires. Other features and advantages will be apparent from the description below and the accompanying figures, and from the claims.

DETAILED DESCRIPTION

Figure 1:
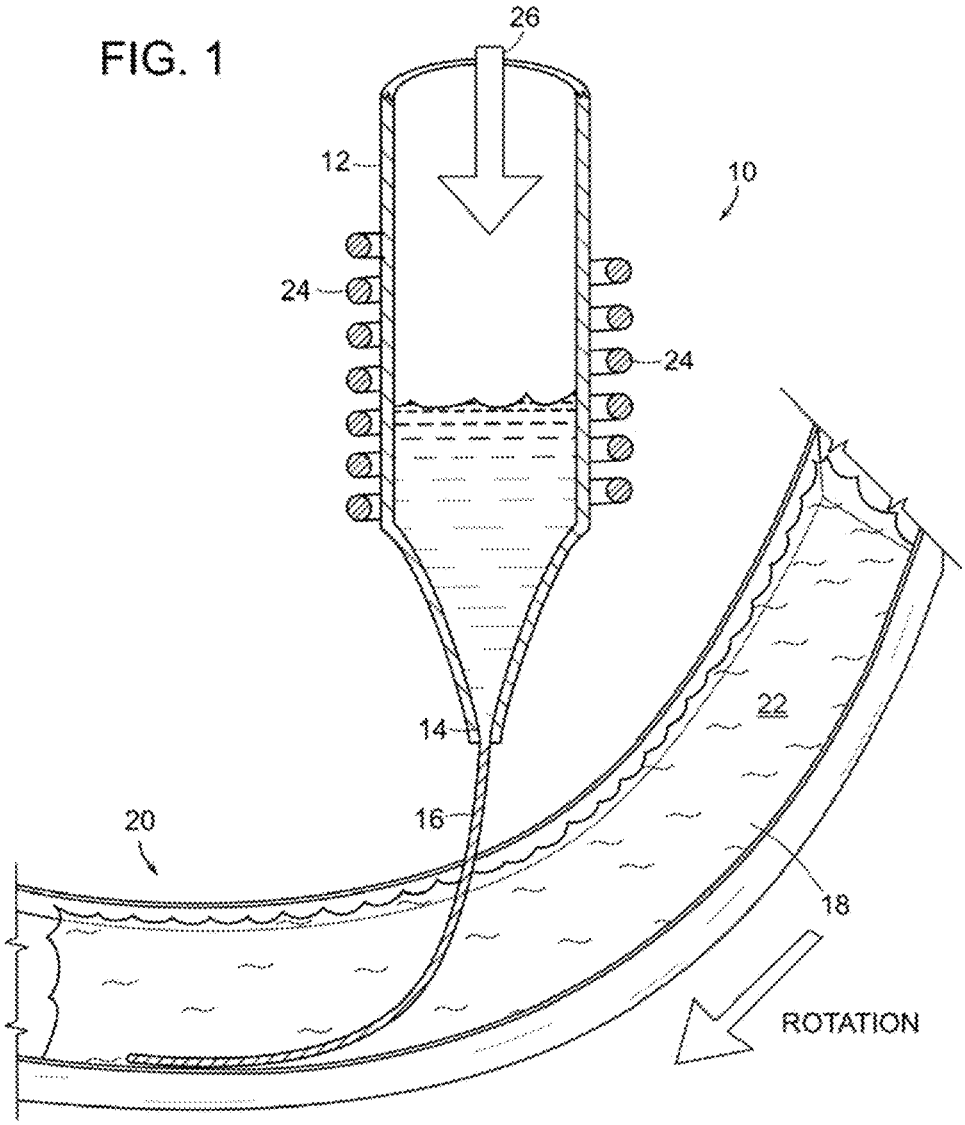
FIG. 1 is a schematic perspective view of an example melt spinning apparatus that can be employed with the melt spinning process provided herein for producing a SMA wire.

Referring to FIG. 1, in the production of crystalline shape memory alloy (SMA) wire, ribbon, or other cross-sectional shape, there can be employed a processing arrangement 10 for carrying out melt spinning, also known as spin casting, or other suitable process. In an example of a melt spinning arrangement, there is provided a crucible, such as a cylindrical quartz crucible 12 having a nozzle 14 arranged for output of wire 16, ribbon, or other structure there from. The crucible is fixedly positioned, e.g., by a manipulator, above a horizontal face 18 of an open-faced vertical rotating drum wheel 20. The drum wheel includes walls on each side of the horizontal face 18 for holding a quenching/casting medium 22. The drum wheel is rotated, in the direction shown in the figure, in a manner that is controlled for SMA microstructure formation.

The crucible 12 is arranged adjacent to induction coils 24 or other suitable heating mechanism, for melting SMA material that is provided within the crucible to form wire, ribbon, or other structure at the nozzle 14. The crucible is also connected to a source of pressure 26, such as gas pressure, for controllably forcing, or ejecting, melted SMA material out of the nozzle 14. Other pressure arrangements, as well as crucible heating arrangements, can be employed as-suitable for a given application.

In production of microscale SMA structures such as SMA wire or microwire with the melt spinning apparatus, bulk solid pieces of SMA material are loaded into the crucible. As explained in detail below, the bulk solid SMA material pieces can be provided with an alloy composition selected to achieve particular SMA microstructure as well as shape memory and superelasticity properties. With the bulk solid SMA material loaded in the crucible, the crucible is then evacuated and a selected inert gas, such as argon gas, is continuously flowed through crucible, e.g., at a pressure of about 0.03-0.044 bars.

The vertical rotating wheel is then operated to rotate at a selected speed, e.g., between about 9 m/s and 13 m/s. While the wheel is rotating, a fluidic quenching/casting medium 22 is introduced into the space between the walls at the horizontal wheel face 18. Suitable fluidic media include liquids and gasses, e.g., water, whale oil, cottonseed oil, mineral oils, helium, chilled air, argon or other inert gas, or other selected liquid or gas. Additives such as polyalkylene glycol (PAG)-based synthetic products can be included. For many applications, water can be preferred as a quenching medium. As the drum wheel is rotated, the cooling medium circulates around the drum wheel.

The temperature of the quenching medium in the drum wheel can be actively controlled, e.g., to a temperature of between about −20° C. and about 50° C.-80° C., for selected quenching media and selected processing applications. Such temperature control can be achieved by, e.g., a refrigeration or heating unit that cools or heats a selected quenching medium and feeds the temperature-controlled medium into the wheel. A selected quenching medium can be cooled or heated to achieve a desired melt casting operation, or the quenching medium can be selected for operation without active temperature control. For example, water as a quenching medium can be thermally controlled to a desired temperature that is above room temperature, or alternatively, unheated oil can be employed to achieve similar quenching results.

While a selected liquid quenching medium is continuously fed into the drum wheel at a selected spin speed, e.g., between about 6 m/s and 7 m/s, the distance between the surface of the liquid and the lower end tip of the crucible nozzle is measured as that distance decreases due to the rising level of the liquid. When the nozzle tip-to-liquid surface distance is at a selected value, e.g., between about 1 cm and about 2 cm, then the feed of liquid quenching media is terminated. The rotational speed of the wheel is then increased to a selected speed, e.g., between about 10 m/s and about 10.25 m/s. As explained in detail below, the wheel speed is preferably controlled based on a selected casting rate to achieve uniform casting structures, for example, to achieve a uniform wire diameter, by matching the wheel speed to the casting rate.

To begin melt spinning of the alloy material, the bulk solid alloy material in the crucible is melted, e.g., with induction coils around the crucible or with another suitable heating configuration. An inert gas, such as argon gas, is preferably continuously flowed through the crucible, out the nozzle, during this heating. A thermocouple or other suitable device can be disposed in the crucible with the alloy material to directly measure the temperature of the material during the heating process. Alternatively, an optical temperature reader or other device can be configured to sense and measure the alloy material temperature accurately from outside the crucible. No particular temperature measurement device is required. When the alloy material starts to melt and flow down through the nozzle to clog the nozzle, the flow of gas through the crucible is terminated and the crucible pressure is reduced to produce a vacuum, e.g., at between about −0.01 bar-about-0.02 bars. The temperature of the melting alloy material is then monitored. When the alloy material is fully melted and is at temperature that is between about 200° C. and about 300° C. above the alloy material melting temperature, defined herein as the liquidus temperature of the alloy composition in its phase diagram, the flow of gas is reintroduced to apply a pressure from the top of the crucible. The pressure flow is preferably sufficient to cause the melted alloy material to eject out of the crucible nozzle and into the quenching medium in the rotating drum. A pressure of about 4 bars can be sufficient for many applications.

As shown in FIG. 1, as the melted alloy material is ejected out of the nozzle 14, the alloy material takes on the cross-sectional geometry of the nozzle and forms a continuous structure 16 that extends into and is collected by the rotating drum. Then as the structure enters the quenching medium, the alloy material solidifies into a continuous length of the cast geometry. To achieve continuous casting of significant lengths of alloy material, the wheel speed can be matched with the casting rate. The casting rate depends on the casting temperature, nozzle size, and pressure. For a given casting rate that results from these conditions, the wheel speed then is accordingly controlled. With wheel speed substantially matched to casting rate, the length of the cast geometry is limited only by the volume of alloy material that can be provided in the crucible. When all melted alloy material has been ejected from the crucible, the wheel rotation can be terminated, the quenching medium can be drained from the wheel, and the cast alloy structure can be collected from the wheel drum and wound or otherwise positioned.

At the conclusion of the melt spinning process, the cast alloy structure can be immediately employed for a selected application without further processing. The melt spinning process is particularly advantageous in that very long lengths of cast structure, such as SMA wire, can be uniformly produced. For example, in one embodiment herein, there is produced by the melt spinning process a continuous SMA wire that is longer than at least about one meter, and preferably that is longer than at least about 1.5 meters. The wire diameter along the length of the fiber is precisely controlled and as a result is highly uniform. The wire diameter uniformity is here specified for this embodiment as about ±5 microns along at least about a 1 meter length of the wire.

The SMA wire that is produced by the melt spinning can exhibit a material microstructure, along the length of the wire, that is polycrystalline, partially oligocrystalline and partially polycrystalline, or substantially fully oligocrystalline. Polycrystalline herein refers to a microstructure condition in which the cast wire is formed of alloy material crystallites of varying size and orientation, conventionally referred to as material grains. The grains of alloy in the polycrystalline SMA wire can be oriented randomly, with no preferred orientation, or can take on a directed orientation.

In one embodiment, the melt spinning is conducted to produce SMA wire that is oligocrystalline. An oligocrystalline alloy structure herein refers to an alloy structure having a polycrystalline microstructure in which the total surface area of the structure is greater than the total area of the polycrystalline grain boundaries within the alloy structure. This condition results in the grains of the alloy material structure being coordinated predominantly by unconfined free surfaces rather than by rigid boundaries with other grains within the structure. For a SMA wire, the condition of oligocrystalline structure is met if the spherical-equivalent average grain size that is calculated from the grain volumes within the wire is larger than the minor axis of the cast wire cross section.

The superelastic characteristics of the oligocrystalline SMA wire can approach those of a single-crystalline, or monocrystalline, structure. In a conventional polycrystalline material, each grain can contain atoms that are in a different crystallographic orientation with respect to each other. Given that the grains are randomly oriented within the cast alloy material, then during a martensitic transformation, neighboring grains can change shape in opposing directions, causing internal stress concentrations in the material. These stress concentrations can lead to intergranular fracture and cracking of the SMA material. In contrast, oligocrystalline alloy material includes grains that are more uniformly oriented, across the short-axis extent of the wire, reducing internal stress concentrations in the wire. The stress-strain characteristic of an oligocrystalline cast SMA wire can therefore far surpass that of a polycrystalline cast SMA structure, by enabling forward and reverse transformation without cracking, and can do so without requiring monocrystalline morphology.

Figure 2:
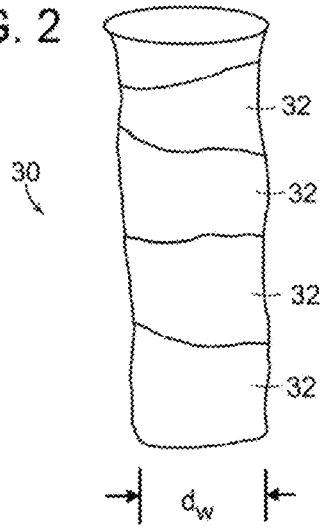
FIG. 2 is a schematic perspective view of a length of SMA wire exhibiting an oligocrystalline grain structure that forms a so-called bamboo structure.

Referring to FIG. 2, in one embodiment, a melt-spun SMA wire 30 is characterized by a diameter, $d_w$, that is no larger than the extent of a grain 32 of the alloy wire. As a result, grains 32 span the entire wire diameter. This arrangement results in a condition of oligocrystalline microstructure conventionally referred to as a so-called bamboo wire structure, in which grains generally spanning the diameter of the wire are configured along the length of the wire. This bamboo configuration can be extended to wire-like structures as well as pillars and other generally cylindrical structures.

In one embodiment, the alloy composition is selected, as described in detail below, in concert with the melt spinning conditions, to produce a SMA wire in an as-cast condition of at least about 1 meter in length and having a material volume that is at least about 50 vol % oligocrystalline, i.e., at least about 50% of the wire volume exhibits a bamboo structure. In one embodiment, the wire is at least about 75 vol % oligocrystalline along the wire length. In one embodiment, the as-cast SMA wire is fully polycrystalline along the wire length. In a further embodiment, the as-cast SMA wire is substantially fully oligocrystalline along the wire length, meaning that the wire is at least about 90 vol % oligocrystalline. These crystallinity conditions can be achieved for a continuous length of wire that is at least about 1 meter long, and with a wire diameter uniformity of at least about ±5 microns along a 1 meter length of the wire. All of these conditions can be achieved with the melt spinning process and the alloy compositions described below without the need for subsequent thermal processing. In other words, upon formation, the SMA wire exhibits this microstructure with thermal treatment, meaning without thermal processing after the melt spinning is completed.

The as-cast SMA wire diameter and condition of wire crystallinity are related. In one embodiment, the as-cast SMA wire diameter is less than about 150 microns and the SMA wire is substantially fully oligocrystalline along a wire length of at least about 1 meter without thermal treatment. Here the term substantially fully oligocrystalline is meant to refer to a condition in which at least about 90 vol % of the volume of the wire length is oligocrystalline. In this embodiment, the SMA wire diameter can be preferably less than about 120 microns, and more preferably can be no more than about 100 microns. In a further embodiment, the as-cast SMA wire diameter is greater than about 150 microns and at least 50 vol % of the SMA wire volume is oligocrystalline along a wire length of at least about 1 meter. In a further embodiment, the as-cast SMA wire diameter is greater than about 150 microns and the SMA wire is substantially entirely polycrystalline.

SMA wires that as-cast from the melt spinning process are polycrystalline can be further processed to cause the wire microstructure to change to become partially or more fully oligocrystalline. In one embodiment of such a process, after the melt casting is complete, a cast alloy structure such as SMA wire can be thermally processed, e.g., can be exposed to a temperature that is at least about half of the melting temperature of the alloy material, or at least about ¾ of the melting temperature of the alloy material, in a controlled atmosphere of, e.g., an inert gas, or in vacuum. This thermal process, herein termed annealing, can be conducted for an annealing duration of, e.g., at least about two hours, and can be beneficial. At the end of the annealing duration, the alloy material structure is quenched, e.g., by submersion in icy water, or other suitable technique.

Any suitable thermal heat treatment can be employed for shifting alloy material microstructure. For example, a multi-step annealing process can be conducted in any selected manner, e.g., to precisely adjust alloy microstructure. In one example multi-step annealing process, a first annealing step is conducted, e.g., at a first, high temperature that is about 50° C. below the alloy material melting temperature, for a duration of between about 0.5 hour and about one hour. Then a second annealing step is conducted at a second, lower temperature, e.g., between about half and about 0.75 of the alloy material melting temperature, for between about one hour and about two hours, immediately after the first annealing step. At the conclusion of the second annealing step, the cast alloy structure is quenched, e.g., in icy water.

The melt spinning method described above and the companion, optional subsequent thermal treatment process also described above, can be conducted to produce continuous, extended lengths of SMA structures, and in particular SMA wire, SMA microwire, and SMA fiber, that exhibit unexpectedly superior shape memory and pseudoelasticity properties. It is discovered that the melt spinning method, when applied to a selected range of alloy compositions, produces SMA wire that achieves unexpectedly very superior performance that far surpasses that of conventional melt-spun wire, and that is similar to the performance of single crystalline, i.e., monocrystalline, SMA wire.

In particular, it is discovered that the alloy components for forming SMA wire, ribbon, or other continuous-length cast structure by the melt spinning process provided herein can be selected to enhance ductility and superelastic recovery of the resulting structure. In one embodiment, the alloy material to be cast by melt spinning includes copper (Cu) and a selected alloying element, such as aluminum (Al). The alloy material further includes, in one embodiment, nickel (Ni), and/or manganese (Mn), e.g., as CuAl, CuALNi, CuAlMn, CuAlMnNi, or other suitable composition.

In one embodiment, it is preferred that for any selected SMA alloy composition, there be included in the composition between about 3% and about 5% of an alloying element that prevents brittle intermetallic phase formation. For example, in one embodiment, the inclusion of Mn to in a CuAlNi alloy prevents brittle γ phase formation (Cu9Al4), imparting a tensile strength greater than transformation stresses, and thereby enabling good superelasticity. The inclusion of between about 3 at % and about 5 at % Mn in a CuAlNi alloy can be preferred.

Addition of an element that increases long-range order in the austenite phase for the given SMA alloy composition is also beneficial to prevent premature failure and thus enhance superelasticity. In many alloys, the position of the different species of atoms are not random; that is, the probability of a pair of atomic sites being occupied by specific atoms is not equal to the random probability obtained by multiplying the respective atomic fractions of those specific atoms. If such ordering occurs only over regions approximately several times the interatomic distances, the ordering is usually termed as short range order. If the ordering persists over distances that are large compared to the interatomic distance, the ordering is denoted as long-range order. Slip in long range ordered phases is usually more difficult than slip in disordered/short range ordered structures, which makes the long range ordered structures more resistant to permanent deformation. In other words, while ordered structures consist of coherent martensite/austenite interface where one-to-one correspondence between atoms exists, incoherent interfaces produce dislocations to accommodate any misfit strains eventually causing degradation of thermoelasticity and superelasticity.

A measure of the degree of order of a material can be obtained by measuring the difference in spacing, Δd, between pairs of atomic planes in the material. A larger Δd corresponds to a higher degree of order. For example, in Cu-based shape memory alloys, a spacing difference, Δd, of about 0.007 nm-0.008 nm corresponds to a condition of long-range order. In one embodiment, given a CuAlNi alloy composition, it can be preferred to include magnesium in the composition. The inclusion of between about 4 at % Mn in a CuAlNi alloy increases the long range order of the CuAlNi austenite phase by imposing an atomic plane spacing difference, Δd, of about 0.007 nm-0.008 nm. The Mn thereby strengthens the alloy and enhances the superelastic recovery while preventing degradation of these properties due to, e.g., formation of a B2 phase with a higher degree of order.

In one embodiment, substantially no grain refiner component is included in the alloy composition to be employed in the melt spinning process. The term grain refiner herein refers to an alloy additive that functions to limit grain growth of the alloy during the casting process. For Cu-based alloys, example grain refiners are titanium, boron, zirconium and chromium. Conventionally, such grain refiners are added to an alloy composition to increase the strength of the cast alloy material. It can be preferred for the alloy compositions described for the melt spinning process herein to restrict an SMA alloy composition to not include any grain refiner components. In one embodiment, the SMA alloy composition includes Cu, Al, Mn, and Ni and excludes a grain refiner component. By prohibiting grain refiners in an SMA alloy composition, no limitation is placed on grain growth in the cast SMA structure. This leads to the ability to produce an oligocrystalline microstructure directly through the casting process. As explained above, the superelastic characteristics of an oligocrystalline structure can approach those of a single-crystalline structure. The melt-spinning process can directly produce an oligocrystalline SMA wire having superelastic characteristics that far surpass those of polycrystalline wire.

The behavior of a melt-spun alloy structure such as a melt-spun wire, at a given service temperature, is controlled by the grain size of the cast wire. The larger the grain size, the larger the possibility to achieve shape memory behavior in the wire, rather than superelasticity, at a given service temperature, because larger grain size, and correspondingly less grain boundary area, favors higher transformation temperatures. Conversely, high alloying element content slows down grain growth during melt spinning solidification and subsequent annealing. A substantially complete bamboo-structured wire can be achieved by annealing at temperatures close to the melting temperature of the alloy. However, grain boundary mobility can be heavily affected by solute concentration in the alloy and very small amounts of impurity may reduce the grain boundary mobility. Here, the term solute refers to the alloying elements, such as Al, Mn and Ni, that are added to the base element, such as Cu. Alloy wires that include a relatively smaller amount of alloying elements are found to tend to grow grains into a bamboo grain structure whereas alloy wires that include a relatively larger solute content tend to exhibit negligible grain growth, resulting in a polycrystalline structure, rather than bamboo structure, under identical annealing conditions. Therefore, the alloy composition range can be optimized to ensure fast grain growth behavior as well as superelasticity at room temperature.

Based on these considerations, the melt spinning process provided herein can be conducted with a selected alloy composition to produce a cast alloy wire having an oligocrystalline microstructure in the as-cast condition, without thermal treatment, e.g., by annealing, to achieve the oligocrystalline state. This oligocrystalline melt-spun wire is continuous, with at least about 1 meter of wire length, and with a diameter uniformity of at least about 5%, so that in one embodiment, the diameter uniformity is ±5 micron along the length of a 100 micron-diameter wire. In one embodiment, Table I below provides the alloy composition and melt spinning processing parameters for achieving the alloy wire that is at least about 90 vol % oligocrystalline and having a length of at least about 1 meter. To achieve this oligocrystalline state as-cast, without thermal treatment, the wire is produced by melt spinning to have a diameter that is no more than about 150 microns, i.e., the wire is 150 microns or less in diameter.

The melt spinning processing parameters, specifically including the ejection pressure, the nozzle size, the wheel speed, and the ejection temperature, operate collectively to produce a corresponding cast wire diameter. For the melt spinning process provided herein, the process parameters can take on a wide range of values that can be controlled to obtain a selected wire diameter. In general, the ejection pressure can be between about 3 bars-6 bars, the nozzle size can be between 150 microns-280 microns, the wheel speed can be about 9 m/s-13 m/s and the ejection temperature can be between about 1100° C.-1400° C. Control of parameters on the high side of these ranges, such as a relatively high ejection temperature and a relatively faster wheel speed, together with a relatively small nozzle size and relatively low ejection pressure, favor casting of smaller diameter wires. For example, a CuAlMnNi alloy wire with at least 1 meter length and a diameter of about 100 microns is obtained when the melted alloy material is ejected through a 250 micron-diameter nozzle at an ejection temperature of about 1300° C. by application of 4 bar ejection pressure onto a wheel spinning with a velocity of 10.2 m/s. Conversely, a CuAlMnNi alloy wire with at least 0.5 m length and a thickness of 200 microns is obtained when the melted alloy material is ejected through a 200 micron-diameter nozzle at an ejection temperature of about 1100° C. by application of 4 bar ejection pressure onto a wheel spinning with a velocity of 10.2 m/s. In this latter example, the resulting cast wire is thicker compared to the former example due to a lower ejection temperature, providing a lower melt viscosity and resulting in a slower ejection speed. To achieve a consistent wire diameter along the wire, the ejection temperature and the nozzle size are controlled together to obtain an ejection speed that is closely matched to the wheel speed.

TABLE I

| Alloy Composition for Melt spinning SMA Wire That is Oligocrystalline as-cast | |
|---|---|
| Aluminum content | 22-24 at % |
| Manganese content | 4-4.5 at % |
| Nickel content | 3.5-3.7 at % |
| Copper content | balance |
| Melt Spinning Parameters for SMA Wire That is Oligocrystalline as-cast | |
| Nozzle size | 200-250 μm |
| Wheel speed | 10.2 m/s |
| Ejection pressure | 4 bar |
| Ejection temperature | 1200-1300° C. |
| Wire diameter | ≤100 microns |

Based on the considerations just described, in a further embodiment, the melt spinning process is conducted in the production of SMA wire having a diameter that is greater than about 150 microns. For this larger-diameter wire, the as-cast wire can be substantially fully polycrystalline or can be partially polycrystalline and partially oligocrystalline. Substantially complete oligocrystalline wire structure along a length of at least about 1 meter of wire, meaning that at least about 90 vol % of the wire is oligocrystalline, can then be achieved, if desired, by annealing the wire after melt spinning in the manner described above. Table II below provides the alloy composition and melt spinning processing parameters for achieving oligocrystalline alloy wire having a diameter greater than about 100 microns.

TABLE II

| Alloy Composition for Melt spinning SMA Wire That is Oligocrystalline After Annealing | |
|---|---|
| Aluminum content | 22-24 at % |
| Manganese content | 4-4.5 at % |
| Nickel content | 3.5-3.7 at % |
| Cu content | balance |
| Melt Spinning + Annealing Parameters for SMA Wire That is Oligocrystalline After Annealing | |
| Nozzle size | 200-250 μm |
| Wheel speed | 10.2 m/s |
| Ejection pressure | 4 bar |
| Ejection temperature | 1200-1300° C. |
| Wire diameter | ≥100 microns |
| Annealing temperature | 800-900° C. |
| Annealing time | 2-3 hours |
| Annealing atmosphere | Argon gas |

With the alloy composition and processing parameters given in both Table I and Table II above, an oligocrystalline CuAlMnNi wire, meaning at least about 90 vol % oligocrystalline, of at least about 1 meter in length, can be produced by the melt spinning process, with a wire diameter uniformity of about 5%. In one embodiment, the CuAlMnNi SMA wire has a diameter of about 150 microns and is substantially fully oligocrystalline as-cast, i.e., at least about 1 meter of the wire is at least 90 vol % oligocrystalline immediately after melt spinning of the 1 meter of wire. In the second embodiment, the CuAlMnNi SMA wire has a diameter greater than about 150 microns and is at least partially oligocrystalline as-cast without thermal treatment; i.e., at least some portion of a 1 meter length of the wire is oligocrystalline as-cast, and after the annealing process, at least about 1 meter of the wire is at least 90 vol % oligocrystalline.

It is found that to achieve a reversible strain of at least about 7% in a melt-spun SMA wire having a Cu—Al-based alloy composition, it is preferable that at least about 50 vol % of the wire be oligocrystalline, i.e., that the bamboo arrangement of grains extend for at least about 50 vol % of the wire. To achieve a reversible strain of at least about 5% in a melt-spun SMA wire having a Cu—Al-based alloy composition, nickel and manganese are both preferably included in the alloy material composition. In one embodiment, an alloy composition for melt spinning SMA wire having a reversible strain of at least about 5% as-cast, with a length of at least about 1 meter, and without thermal processing, includes 20 at %-28 at % Al, 3.5 at %-4.5 at % Mn, 2.4 at %-3.7 at % Ni, and the balance of the composition Cu. The as-cast alloy wire may under some processing parameters be polycrystalline rather than oligocrystalline, as explained above, but even in the polycrystalline state can achieve a reversible strain of least about 5% after the melt spinning process.

With a particular SMA composition selected, the composition is mixed and prepared for the melt spinning process. In one example method for preparing an alloy composition, elemental powders are mixed in a desired proportion, such as aluminum between about 20 at %-28 at %, manganese between about 3.5 at %-4.5 at %, nickel between about 2.4 at %-3.7 at %, and the balance copper. In one embodiment, a composition for enhanced grain growth both in melt spinning solidification and in annealing processes, and for good superelasticity at room temperature, includes Al between about 22 at %-24 at %, Mn between about 4 at %-4.5 at % and Ni between about 3.5 at %-3.7 at %. Preferably the starting powders have a purity of at least about 99.5%. Preferably grain refiner elements are excluded from the composition.

The selected elemental powder mixture is encapsulated in a quartz tube, the tube evacuated, and then the tube back-filled with, e.g., an inert gas such as argon at a pressure of, e.g., about 120 mmHg. The mixture is then melted in the quartz ampule by heating, for example in an induction furnace, at a temperature of between about 1200° C. and about 1300° C. during a heating ramp duration of between about 10 and about 20 minutes. Once the selected melting temperature is reached, the mixture is maintained at this dwell temperature for a selected duration, e.g., between about 2 minutes and about 5 minutes. Subsequent to the dwell time, the resulting alloy is slowly cooled in the quartz ampule, e.g., with a ramp-down duration to room temperature of between about 10 minutes and about 20 minutes. To obtain better homogenization, this procedure can be repeated 2-3 times and/or the melt can be vigorously shaken to ensure good mixing. The alloy pieces can then be loaded into the quartz melt spinning crucible and the melt spinning process commenced in the manner described above.

Experimental Example 1

An alloy composition of 22.3 at % Al, 4.4 at % Mn, 3.6 at % Ni and balance Cu was mixed and provided as a solid alloy material in a crucible for melt spinning into a wire. The experimental melt spinning parameters are given in the table below. After melt spinning, the resulting cast wire was annealed following the annealing parameters given in the table below.

| Experimental Melt Spinning + Annealing Parameters | |
|---|---|
| Nozzle size | 250 μm |
| Wheel speed | 10.2 m/s |
| Ejection pressure | 4 bar |
| Ejection temperature | 1300° C. |
| Annealing temperature | 800° C. |
| Annealing time | 3 hours |
| Annealing atmosphere | Argon gas |

Figure 3:
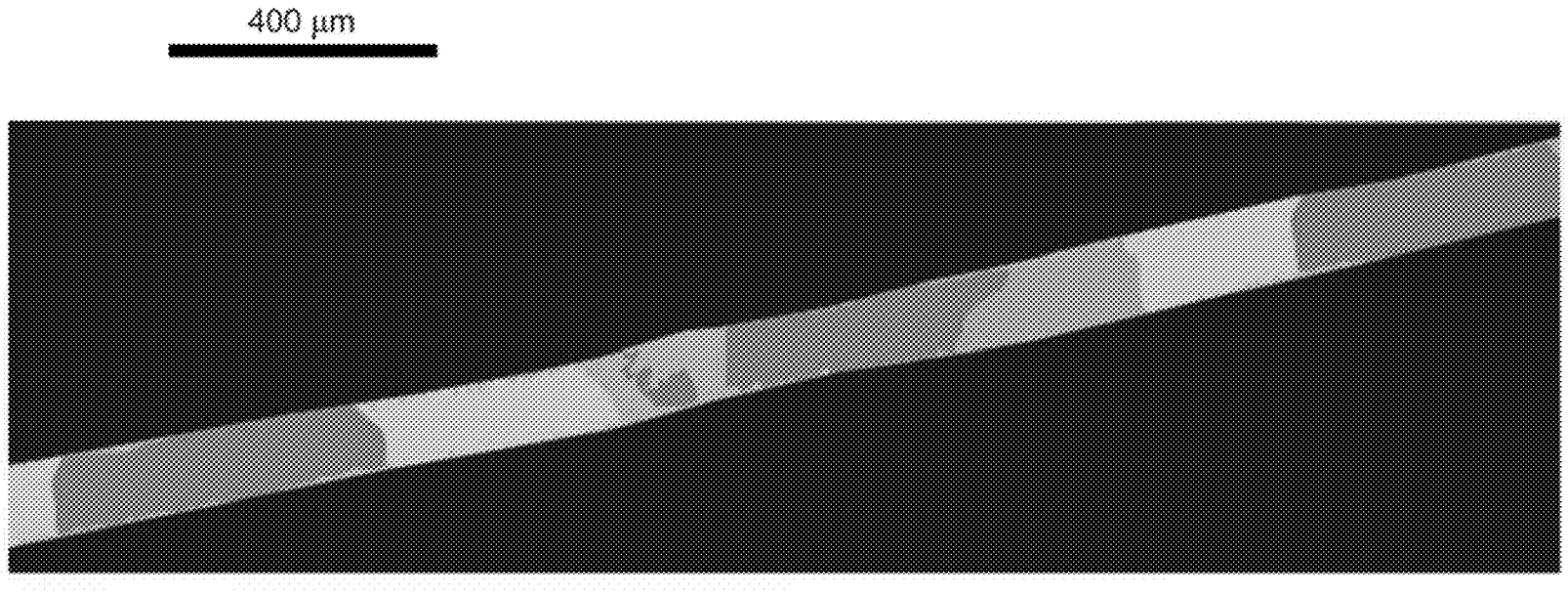
FIG. 3 is a montage of cross-sectional micrographs of an experimental CuAlMnNi wire produced by melt spinning and annealing.

The resulting wire had a diameter of 100 microns and a wire length of a little less than about 1.5 meter. The austenite finish temperature for the wire was measured to be about −3° C. FIG. 3 is a montage of micrographs along the length of the wire. As shown in this montage view, a small region of polycrystalline material exists, but at least about 90 vol % of the wire is substantially oligocrystalline.

A length of 10 mm from the cast wire was mechanically tested using dynamic mechanical analysis (DMA) equipment, here consisting of a stationary upper clamp and a movable lower clamp holding the wire from both ends. Each end of the wire was mounted in a plastic compound to form sound mechanical grips which were then clamped. Cross-head displacement was measured by a high resolution linear optical encoder within the instrument, with a nominal resolution of 1 nm. The mechanical test was performed at a temperature around 30° C. higher than the austenite finish temperature, and was conducted by applying a load at a rate of 20 MPa/min and measuring the resulting elongation of the wire. This set-up was confined in a closed chamber that could be heated or cooled to a desired testing temperature. The temperature of the chamber was measured by a thermocouple placed 1 mm away from the wire.

Figure 4:
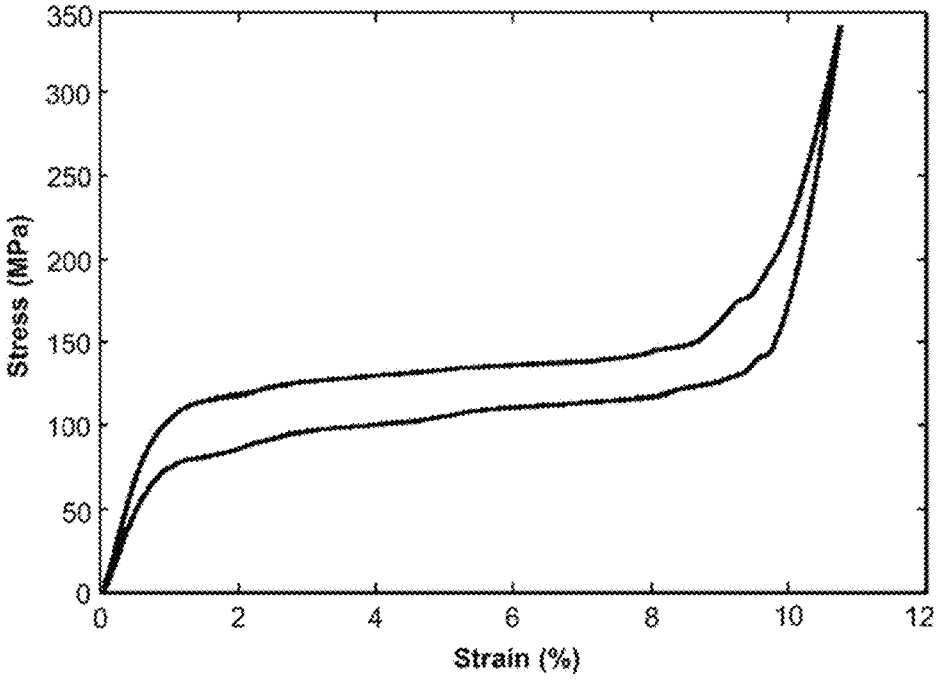
FIG. 4 is a plot of measured stress-strain properties for the CuAlMnNi wire of FIG. 3 produced by the melt spinning process, exhibiting a recoverable strain of more than 10%.

The measured stress-strain characteristic for the SMA wire is plotted in FIG. 4. As shown in FIG. 4, a reversible, recoverable strain of 10.82% was experimentally achieved for this SMA wire. This unexpectedly superior result far surpasses the recoverable strain that is conventionally achieved for Cu-based SMA wire. This demonstrates that melt spinning of a CuAlMnNi alloy composition into a wire of less than about 150 microns in diameter, and preferably 100 microns or less in diameter, can achieve an oligocrystalline structure that produces strain recovery like that of monocrystalline materials having the same composition. Indeed, this high degree of strain recovery exceeds testing examples of monocrystalline SMA wires, which are generally reported to be slightly less than 10%. The Cu-based wire produced by the melt spinning process provided herein achieves superelastic behavior that surpasses even monocrystalline SMA wires that are considered ideal, which is to say single crystalline and having a favorable orientation with respect to the loading direction.

Experimental Example II

Two SMA wires were separately cast by the melt spinning process and then annealed. The first wire, Wire 1, had an alloying element content of 30 at % and the second wire, Wire 2, had an alloying element content of 33.1 at %. The wire compositions are given as follows:

| | Cu (at %) | Al (at %) | Mn (at %) | Ni (at %) |
|---|---|---|---|---|
| Wire 1 | Bal | 23 | 3.6 | 3.4 |
| Wire 2 | Bal | 27 | 3.6 | 2.5 |

The melt spinning and annealing conditions employed for the two wires are given in Table III below.

TABLE III

| | Alloy | Alloying element content | Nozzle size | Wheel speed | Ejection pressure | Ejection temperature | Diameter | Longest continuous length | Annealing temperature and time |
|---|---|---|---|---|---|---|---|---|---|
| Wire 1 | Cu—Al—Mn—Ni | 30 at % | 250 μm | 10.1 m/s | 4 bar | 1200° C. | 270-330 μm | 50 cm | 900° C. - 3 h |
| Wire 2 | Cu—Al—Mn—Ni | 33.1 at % | 200 μm | 10.2 m/s | 4 bar | 1100° C. | Short axis = 120 μm Long axis = 250 μm | 40 cm | 900° C. - 3 h |

Although the ejection temperature and nozzle size were different for the two melt spinning processes, these variables are known to not have any immediate influence on grain growth properties of the SMA material during the annealing process.

Figure 5A:
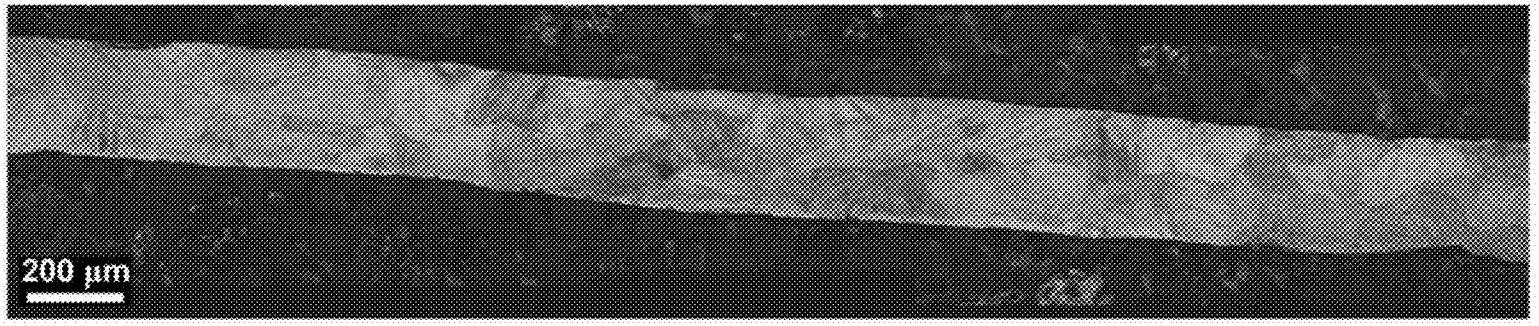
FIG. 5A and FIG. 5B are a cross-sectional micrograph and an illustration of the grains in the cross-sectional micrograph, respectively, for an as-cast length of wire produced by melt spinning with an example alloy composition of CuAlMnNi.
Figure 5B:
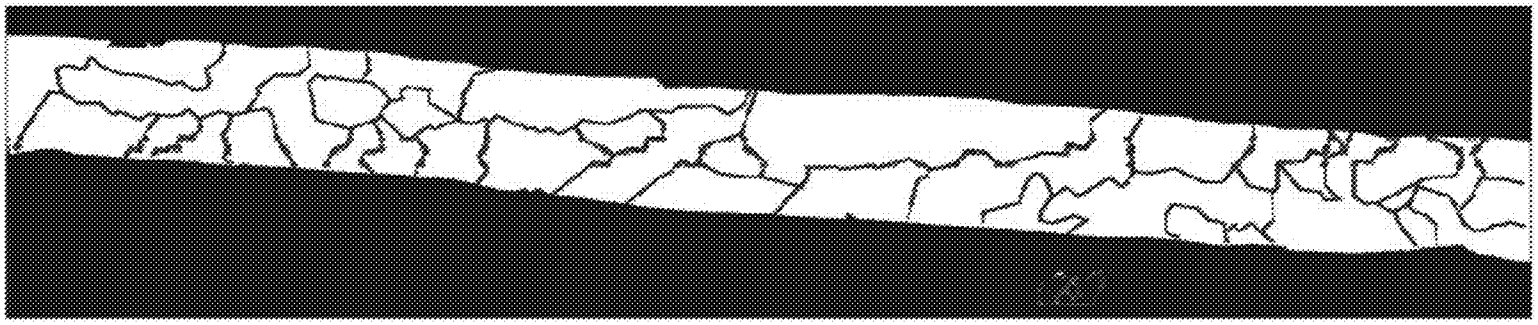
Figure 6A:
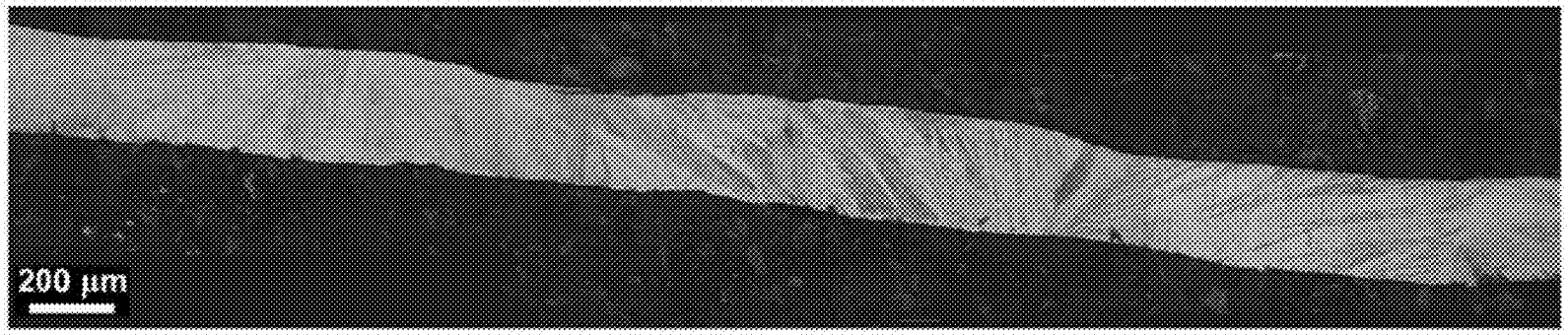
FIG. 6A and FIG. 6B are a cross-sectional micrograph and an illustration of the grains in the cross-sectional micrograph, respectively, for the length of wire shown in FIGS. 5A-5B after a subsequent annealing process as provided herein.
Figure 6B:
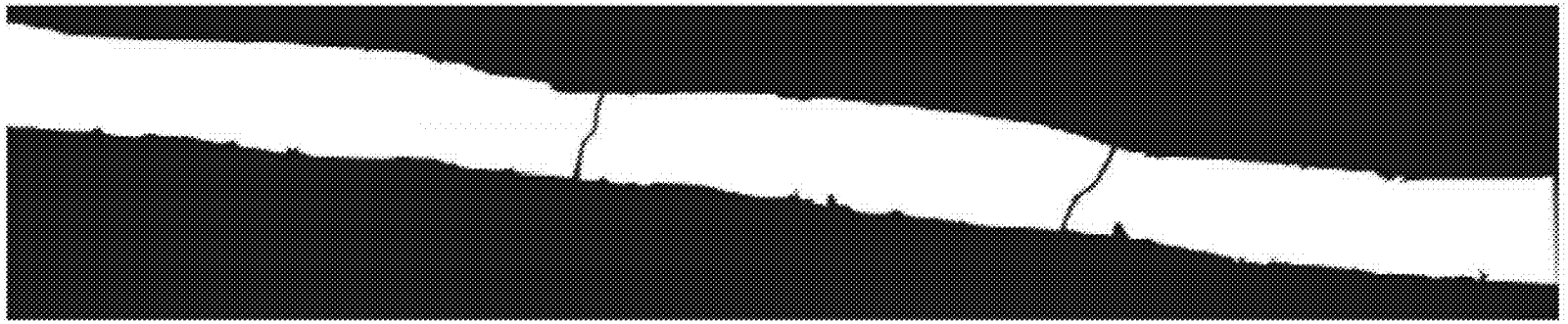

FIG. 5A is a cross-sectional micrograph of the Wire 1 as-cast and FIG. 5B is an illustration marking the grain boundaries in the micrograph of FIG. 5A. FIG. 6A is a cross-sectional micrograph of the Wire 1 after the annealing process and FIG. 6B is an illustration marking the grain boundaries in the micrograph of FIG. 6A. As shown in these figures, the microstructure of the Wire 1 upon casting was substantially completely polycrystalline. After the annealing process, the microstructure of Wire 1 was substantially completely oligocrystalline.

Experimental Example III

Two SMA wires were separately cast by the melt spinning process and then annealed. Each of the wires included copper, aluminum and nickel. The first wire had an alloying element content of 33.1 at % and also included manganese. The second wire had an alloying element content of 30.5 wt % and did not include manganese. The atomic wt % of each element for Wire 1 and Wire 2 are given below:

| | Cu (at %) | Al (at %) | Mn (at %) | Ni (at %) |
|---|---|---|---|---|
| Wire 1 | Bal | 27 | 3.6 | 2.5 |
| Wire 2 | Bal | 26.3 | 0 | 3.5 |

The melt spinning and annealing conditions employed for the two wires are given in Table IV below.

TABLE IV

| | Alloy | Alloying element content | Nozzle size | Wheel speed | Ejection pressure | Ejection temperature | Diameter | Longest continuous length | Annealing temperature and time |
|---|---|---|---|---|---|---|---|---|---|
| Wire 1 | Cu—Al—Mn—Ni | 33.1 at % | 200 μm | 10.2 m/s | 4 bar | 1100° C. | 180-250 μm | 40 cm | 900° C. - 3 h |
| Wire 2 | Cu—Al—Ni | 30.5 at % | 200 μm | 10.2 m/s | 4 bar | 1300° C. | 230-270 μm | 100 cm | 900° C. - 5 h |

Figure 7A:
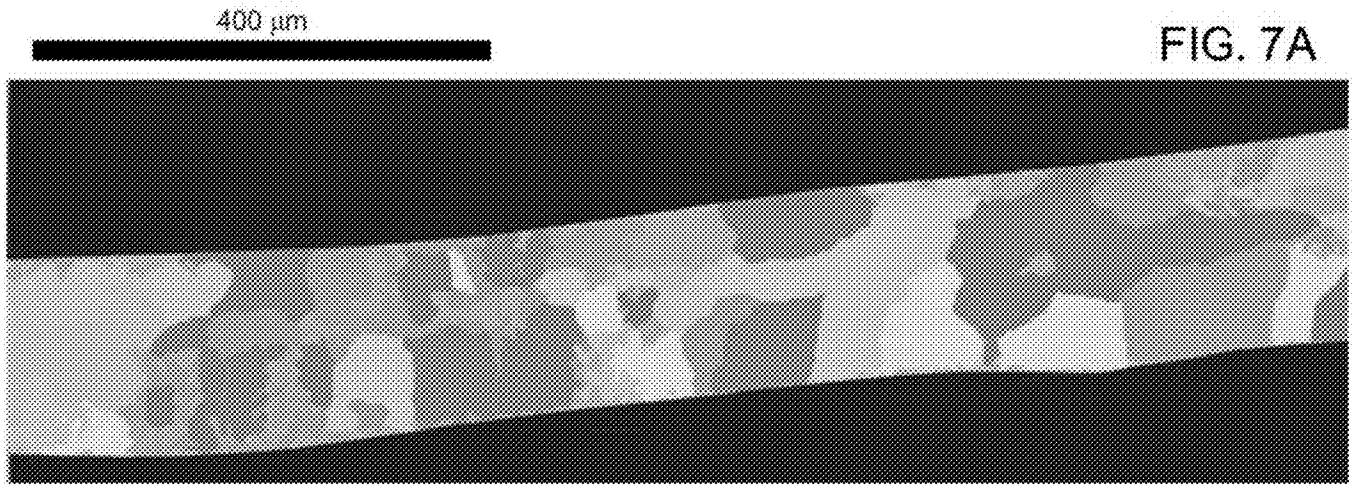
FIG. 7A and FIG. 7B are cross-sectional micrographs of a length of wire as-cast by melt spinning and after subsequent annealing, respectively, for an example alloy composition of CuAlMnNi.
Figure 7B:
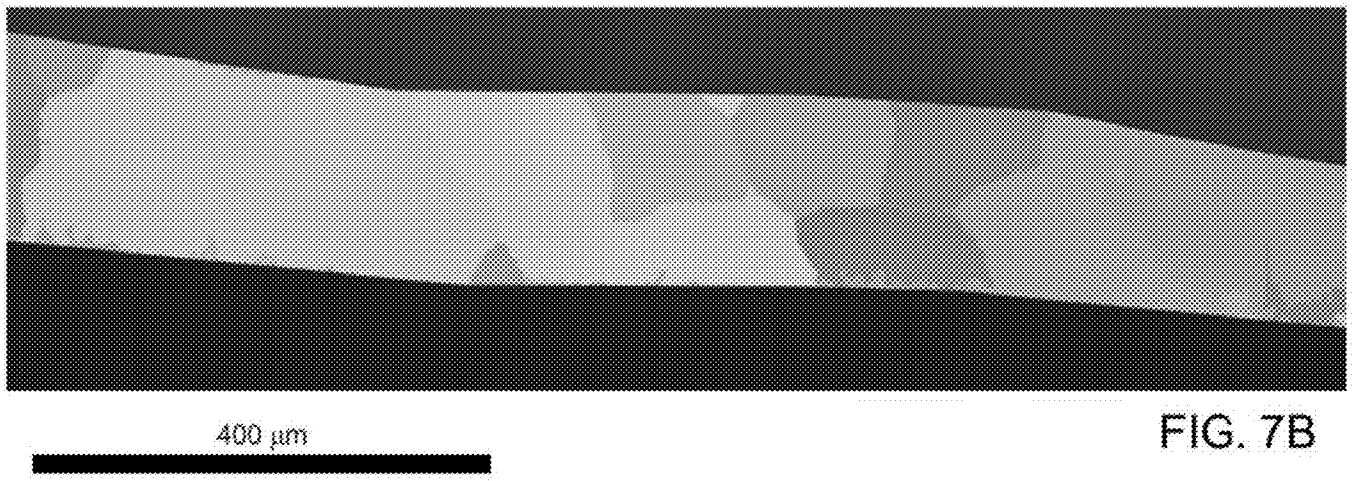

FIG. 7A is a cross-sectional micrograph of the Wire 2 as-cast and FIG. 7B is a cross-sectional micrograph of the Wire 2 after the annealing process. As shown in these FIGS. 7A-7B, the microstructure of Wire 2 upon casting was substantially completely polycrystalline and remained completely polycrystalline even after the annealing process.

These experimental results demonstrate that when the amount of Al is higher than between about 23 at %-24 at %, with a total alloying element content, i.e., a solute content, higher than about 30 at %, grain growth into a fully oligocrystalline microstructure is unachievable even with annealing processes. Under identical annealing conditions, the low-alloy composition Wire 1 successfully shifted microstructure from polycrystalline to oligocrystalline by annealing, while the high-alloy composition Wire 2 could not shift between polycrystalline and oligocrystalline microstructures.

This experimental example supports an embodiment provided herein in which a total alloying element content of no more than about 30 at % is included and a maximum content of Al of 24 at %, to ensure that substantially completely oligocrystalline structure can be obtained by a combination melt spinning and annealing process. Grain growth is sensitive to even slight differences in alloy content.

Figure 8A:
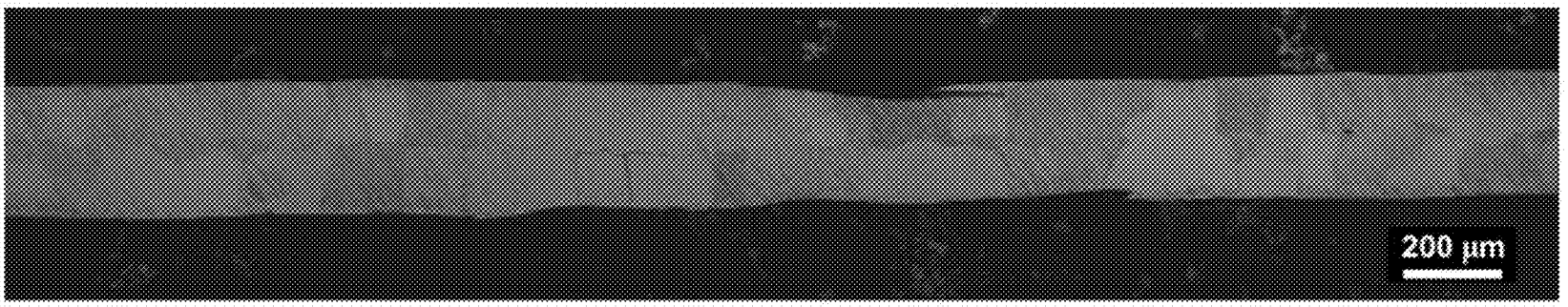
FIG. 8A and FIG. 8B are cross-sectional micrographs of two different wires, both cast by melt spinning with subsequent annealing, for a composition of CuAlMnNi and for a composition of CuAlNi, respectively.
Figure 8B:
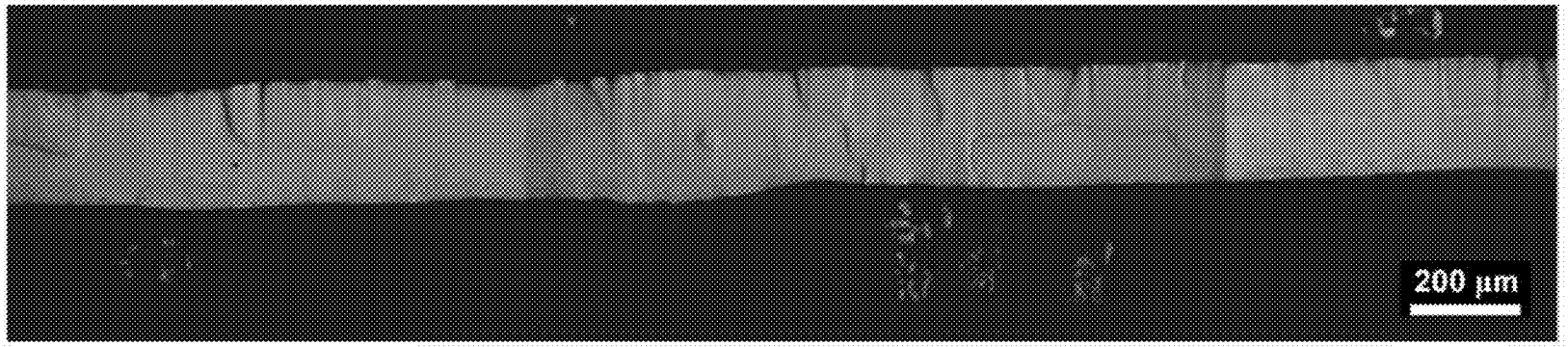

FIG. 8A is a cross-sectional micrograph of the Wire 1, including Mn, after annealing, and FIG. 8B is a cross-sectional micrograph of the Wire 2, excluding Mn, after annealing. Both wires exhibited a substantially completely polycrystalline grain structure, with comparable grain sizes.

The two annealed wires were subjected to a tensile test using the dynamic mechanical analysis (DMA) equipment described above. The mechanical testing was performed by applying a loading at a rate of 20 MPa/min and measuring the resulting elongation of the wires. This set-up was inside a closed chamber that could be heated or cooled to the desired testing temperature. The temperature of the chamber was measured by a thermocouple placed 1 mm away from the wire. The austenite finish temperature of Wire 1 was −114° C. and the test on this wire was conducted at a temperature of −30° C. The austenite finish temperature of Wire 2 was 20° C. and the test on this wire was conducted at a temperature of 80° C.

Figure 9A:
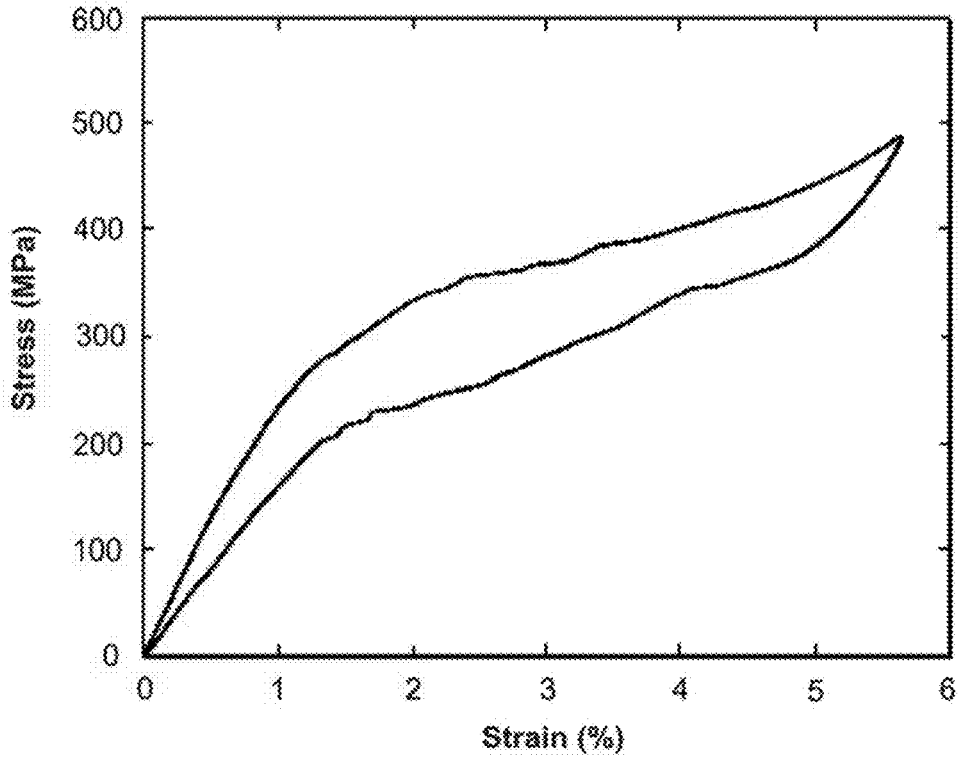
FIG. 9A and FIG. 9B are plots of the measured stress-strain properties of the annealed wires shown in the micrographs of FIG. 8A and FIG. 8B, respectively.
Figure 9B:
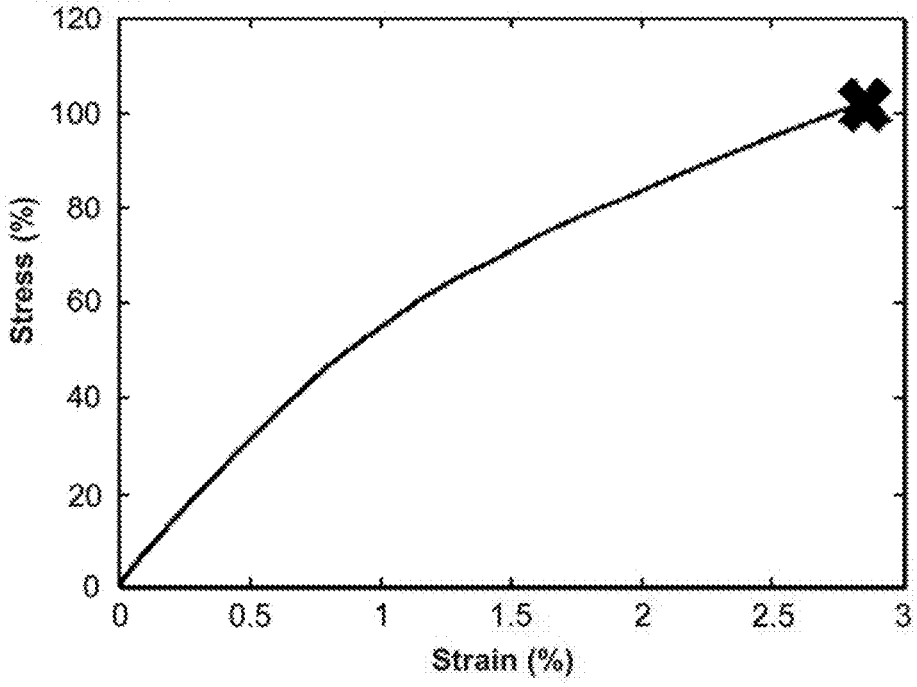

FIG. 9A is a plot of the measured stress-strain characteristic for Wire 1, including Mn, and FIG. 9B is a plot of the measured stress-strain characteristic for Wire 2, not including Mn. As shown in the plots, Wire 1, including Mn, exhibited a recoverable strain up to about 6%, even with a polycrystalline microstructure. Wire 2, not including Mn, prematurely broke at a strain of less than 3%.

This demonstrates that with the inclusion of manganese, a CuAlNi alloy can be melt spun into a SMA wire that achieves significant recoverable strain even with a polycrystalline grain microstructure. Without the inclusion of manganese, a polycrystalline CuAlNi wire cannot sustain a strain of even 3%.

Experimental Example IV

Two SMA wires were separately cast by the melt spinning process and then annealed. Each of the wires included copper, aluminum, nickel, and manganese. The alloying element contents of the two wires are given as:

| | Cu (at %) | Al (at %) | Mn (at %) | Ni (at %) |
|---|---|---|---|---|
| Wire 1 | Bal | 27 | 3.6 | 2.5 |
| Wire 2 | Bal | 22.3 | 4.4 | 3.6 |

The melt spinning and annealing conditions employed for the two wires are given in Table V below.

TABLE V

| | Alloy | Alloying element content | Nozzle size | Wheel speed | Ejection pressure | Ejection temperature | Diameter | Longest continuous length | Annealing temperature and time |
|---|---|---|---|---|---|---|---|---|---|
| Wire 1 | Cu—Al—Mn—Ni | 33.1 at % | 200 μm | 10.2 m/s | 4 bar | 1100° C. | Short axis = 110 μm Long axis = 220 μm | 40 cm | 900° C. - 3 h |
| Wire 2 | Cu—Al—Mn—Ni | 30.7 at % | 250 μm | 10.2 m/s | 4 bar | 1300° C. | 100 μm | >100 cm | 800° C. - 3 h |

Wire 1 had an elliptic cross section with a long axis diameter of 220 microns and a short axis diameter of 110 microns. Wire 1 had a circular cross section of 100 microns in diameter. After melt spinning and before annealing, the microstructure of the two wires was inspected. It was determined that Wire 2, having a diameter of 100 microns, exhibited an almost completely oligocrystalline microstructure. Wire 1, having a long axis of 220 micron and a short axis of 110 microns exhibited an almost completely polycrystalline microstructure.

Figure 10A:
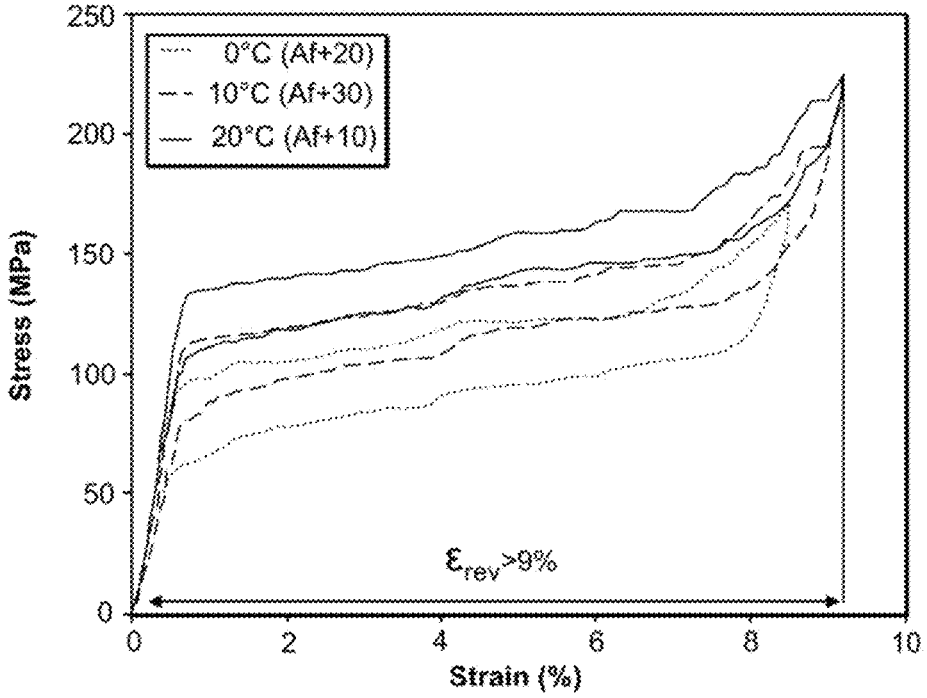
FIG. 10A and FIG. 10B are plots of the measured stress-strain property and superelasticity, respectively, of an as-cast wire of CuAlMnNi having a diameter of 100 microns.

Wire 2, having a diameter of 100 microns, was subject as-cast to tensile testing at three temperatures above the austenite finish temperature, $A_f$. The test was employed under same conditions given above for Examples I and III. FIG. 10A is a plot of the measured recoverable strain results, demonstrating a reversible strain, $\varepsilon_{rev}$, of greater than 9% for the as-cast, un-annealed wire.

The Wire 2 was also subject to thermal cycling under two separate constant external stresses, namely, 40 MPa and 60 MPa, also as-cast, unannealed. For this test, the wire with a length of 10 mm was mounted from each end of the wire in a plastic compound to form sound mechanical grips which were then clamped in the temperature controlled closed furnace of the Dynamic Mechanical Analyzer. The wire was subjected to 40 MPa constant stress and cooled from 60° C. to −80° C. with a rate of 2° C./min. Elongation was recorded starting from the temperature at which transformation from austenite and martensite takes place. Then the wire was heated from −80° C. to 60° C. with a rate of 2° C./min. Contraction was recorded starting from the temperature at which transformation from martensite to austenite takes place. This temperature cycle was repeated under 60 MPa constant stress.

Figure 10B:
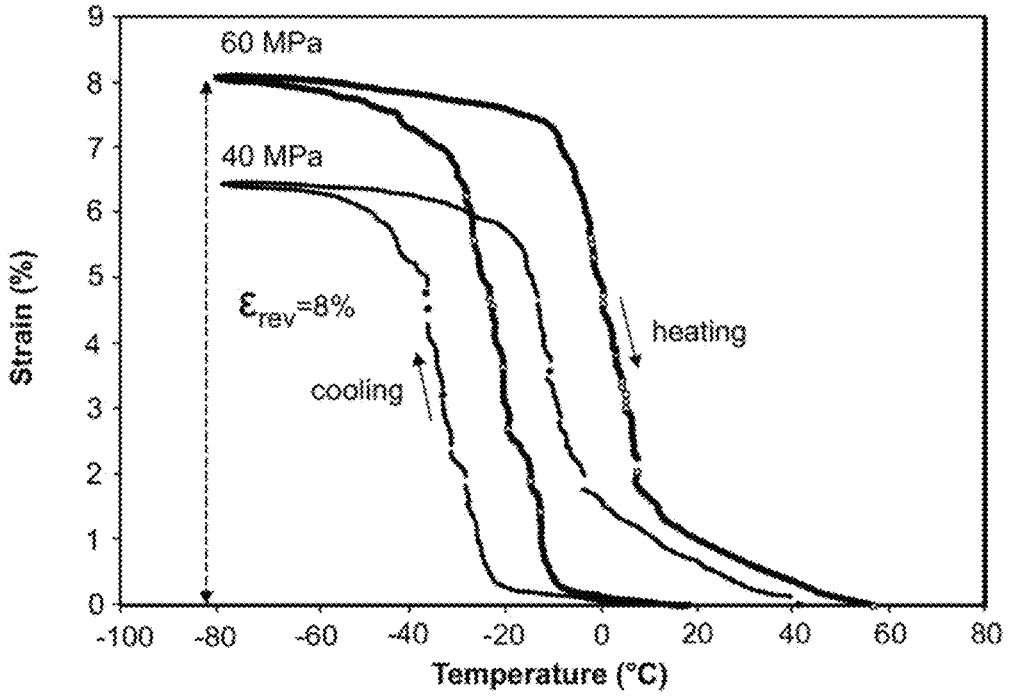

FIG. 10B is a plot of the thermally-induced strain response. Here excellent two-way shape memory behavior is demonstrated, with a reversible strain, $\varepsilon_{rev}$, of about 8%. These results verify that melt spinning of the CuAlMnNi alloy, without grain refiner, and under the melt spinning conditions provided herein, produce CuAlMnNi wire with excellent superelastic and shape memory properties. No annealing is required to obtain these unexpectedly superior capabilities.

Figure 11A:
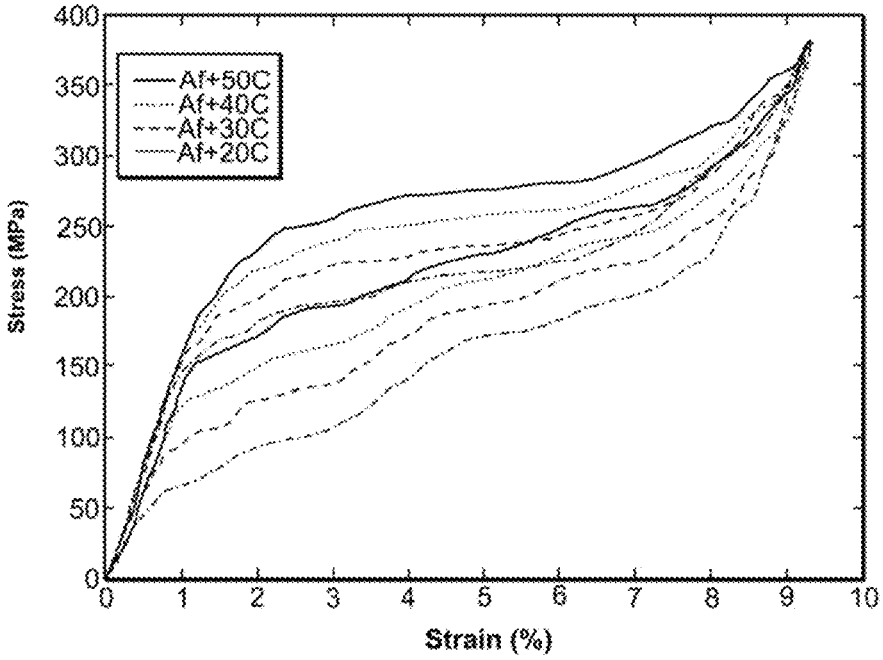
FIG. 11A and FIG. 11B are plots of the measured stress-strain property and superelasticity, respectively, for the wire for which the properties in FIGS. 10A-10B are plotted, after subsequent annealing of the wire.

The two wires were then subjected to the annealing processes given in Table 6. Wire 1 was subjected to a higher annealing temperature due to its larger diameter compared to Wire 2 to ensure temperature homogeneity throughout the wire cross section. Wire 1 and Wire 2 were then subjected again to tensile testing at temperatures above the austenite finish temperature, $A_f$. The superelastic testing procedure employed here was the same procedure given above for Example I and Example III. The loading-unloading cycle was repeated at 3 or 4 different temperatures above Af. Wire 1, although still partially polycrystalline, showed reversible strains around 9%. FIG. 11A is a plot of the measured recoverable strain results, demonstrating a reversible strain, $\varepsilon_{rev}$, of close to 10% for the annealed wire.

Figure 11B:
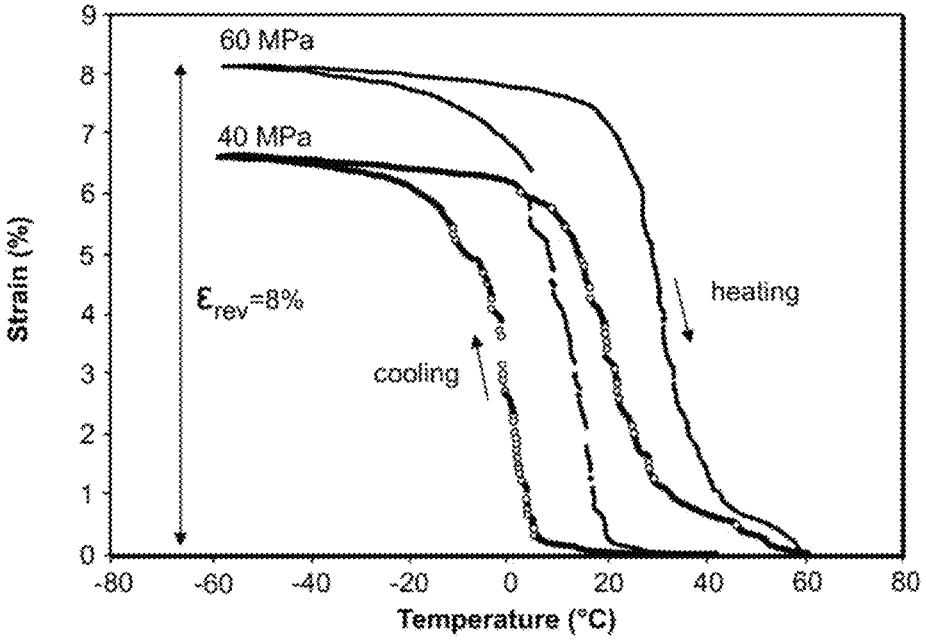

The annealed Wire 2 was also subject to thermal cycling under two separate constant external stresses, namely, 40 MPa and 60 MPa. For this test, a 10 mm length of the wire was mounted with each end of the wire in a plastic compound to form sound mechanical grips which were then clamped in the temperature controlled closed furnace of the Dynamic Mechanical Analyzer. The wire was subjected to 40 MPa constant stress and cooled from 60° C. to −70° C. with a rate of 2° C./min. Elongation of the wire was recorded starting from the temperature at which transformation from austenite and martensite took place. Then the wire was heated from −70° C. to 60° C. with a rate of 2° C./min. Contraction was recorded starting from the temperature at which transformation from martensite to austenite takes place. This temperature cycle was repeated under 60 MPa constant stress. FIG. 11B is a plot of the thermally-induced strain response. Here excellent two-way shape memory behavior is demonstrated, with a reversible strain, $\varepsilon_{rev}$, of about 8%.

This experimental example demonstrates that as-cast, the CuAlMnNi melt-spun wire having a diameter of less than 150 microns, and preferably 100 microns or less, exhibits unexpectedly superior strain recovery capability, and that with annealing, the cast wire exhibits strain recovery behavior that approaches strain recovery that conventionally is achievable only with monocrystalline alloy materials.

The discussion, description, and examples presented above together provide a melt spinning method that when applied to a CuAlMnNi alloy having a selected range of elemental composition as explained above, produces a cast SMA structure, such as a wire, that exhibits recoverable strain of at least about 5%, over a wire length of at least about 1 meter, with diameter uniformity of about is ±5 microns along 1 meter length of wire. For many alloy compositions, as given above, a recoverable strain of at least about 9%, and even 10% can be achieved with the melt spinning process and without thermal processing. For wires not achieving this high recoverable strain, with subsequent annealing of the wire, a recoverable strain of about 10% can be achieved. A wire microstructure that is at least partially oligocrystalline is produced by the melt spinning process with the selected alloy compositional range, and a wire of at least about 90% oligocrystalline microstructure can be achieved, as-cast for some compositions and with annealing for others. The process can be generalized to melt spinning of any suitable alloy geometry, such as ribbon, fiber, microwire, or other geometry, and does not limit further wire processing; in general, any suitable subsequent processing can be conducted as needed for a given application.

The combination of copper-based alloy composition and melt spinning parameters thereby provide unexpectedly high-performance SMA wire having very superior performance characteristics. The performance far surpasses that of conventional melt-spun wire and is comparable to that of single crystalline wire. Copper-based SMA structures are important as an alternative to more costly TiNi SMA counterparts. The Cu-based wire structures provided herein achieve such superior SMA and superelastic properties that many technical applications now addressed predominantly only by TiNi alloys can be successfully implemented with lower-cost Cu-based alloys. Electrical connectors used in electronic sockets, e.g., for fast data transfer, surgical and medical guide wires, dental braces, intelligent fabrics, like smart curtains that coil up when warmed by sun light, are among the many applications of these low-cost SMA wires.

It is recognized that those skilled in the art may make modifications and additions to the embodiments described above without departing from the spirit and scope of the present contribution to the art. It is to be understood that the protection sought to be afforded hereby should be deemed to extend to the subject matter claims and all equivalents thereof fairly provided within.

We claim:

1. A shape memory alloy wire comprising:

an alloy composition comprising CuAlMnNi and excluding grain refiner elements, said alloy composition including 20 at %-28 at % Al, 2 at %-4 at % Ni, 3 at %-5 at % Mn with Cu as a remaining balance of the alloy composition;

said alloy composition being disposed as an elongated wire of at least about 1.5 meters in length, having a wire diameter of less than about 150 microns; and at least about 50 vol % of said alloy composition along said wire length having an oligocrystalline microstructure as-disposed in the wire and without thermal treatment of the wire.

2. The shape memory alloy wire of claim 1 wherein at least about 75 vol % of said alloy composition along said wire length is oligocrystalline.

3. The shape memory alloy wire of claim 1 wherein at least about 90 vol % of said alloy composition along said wire length is oligocrystalline.

4. The shape memory alloy wire of claim 1 wherein the wire exhibits a strain recovery of at least about 8% at room temperature.

5. The shape memory alloy wire of claim 1 wherein the wire exhibits a strain recovery of at least about 10% at room temperature.

6. The shape memory alloy wire of claim 1 wherein said alloy composition includes 22 at %-24 at % Al, 3.5 at %-3.7 at % Ni, 4 at %-4.5 at % Mn, and with Cu as a remaining balance of the composition.

7. The shape memory alloy wire of claim 1 wherein said alloy composition includes 22.3 at % Al, 4.4 at % Mn and 3.6 at % Ni.

8. The shape memory alloy wire of claim 1 wherein the diameter of the wire is no more than about 100 microns.

9. The shape memory alloy wire of claim 1 wherein the diameter of the wire is less than about 120 microns.

10. The shape memory alloy wire of claim 1 wherein the wire diameter has a diameter uniformity of ±5 microns along a 1 meter length of the wire.

11. The shape memory alloy wire of claim 1 wherein the wire has an atomic place spacing difference of between 0.007 nm and 0.008 nm.

12. The shape memory alloy wire of claim 1 wherein no more than about 30% of the alloy composition consists of Al, Mn, and Ni.

13. The shape memory alloy wire of claim 1 wherein the wire exhibits a strain recovery that is at least as large as a strain recovery that is exhibited by a monocrystalline wire having a composition including 20 at %-28 at % Al, 2 at %-4 at % Ni, 3 at %-0.5 at % Mn with Cu as a remaining balance of the alloy, and having a monocrystalline length of about 1 meter in length and a monocrystalline wire diameter of less than about 150 microns.

14. A shape memory alloy wire comprising:

an alloy composition comprising CuAlMnNi and excluding grain refiner elements, said alloy composition including 20 at %-28 at % Al, 2 at %-4 at % Ni, 3 at %-5 at % Mn with Cu as a remaining balance of the alloy composition;

said alloy composition being disposed as an elongated wire of at least about 1.5 meters in length, having a wire diameter of at least about 150 microns; and at least about 50 vol % of said alloy composition along said wire length having an oligocrystalline microstructure.

* * * * *